US007950933B1

(12) United States Patent
Harlan

(10) Patent No.: US 7,950,933 B1
(45) Date of Patent: May 31, 2011

(54) ELECTRICAL SOCKET HAVING CONTACT TERMINALS FLOATABLY ARRANGED THEREIN

(75) Inventor: Tod M. Harlan, Mechanicsburg, PA (US)

(73) Assignee: Hon Hai Precison Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/849,814

(22) Filed: Aug. 4, 2010

(51) Int. Cl.
*H01R 4/58* (2006.01)

(52) U.S. Cl. ..... 439/91; 439/591; 439/906

(58) Field of Classification Search ..... 439/66, 439/91, 591, 906
See application file for complete search history.

(56) References Cited

U.S. PATENT DOCUMENTS 5,414,369 A * 5/1995 Kazama ..... 324/755.05
5,990,697 A * 11/1999 Kazama ..... 324/755.05
6,114,757 A * 9/2000 DelPrete ..... 257/678
6,556,033 B1 * 4/2003 Kazama ..... 324/755.05
6,722,893 B2 * 4/2004 Li et al. ..... 439/66
6,776,624 B2 * 8/2004 Suematsu ..... 439/71
6,877,990 B2 4/2005 Liao et al.
7,021,942 B2 * 4/2006 Grant et al. ..... 439/66
7,044,746 B2 5/2006 Copper et al.
7,104,803 B1 * 9/2006 Lloyd et al. ..... 439/66
7,241,147 B2 * 7/2007 Lloyd et al. ..... 439/66
7,463,041 B2 * 12/2008 Kazama ..... 324/755.05
7,479,016 B2 * 1/2009 Takahashi et al. ..... 439/66

* cited by examiner

*Primary Examiner* — James Harvey
(74) *Attorney, Agent, or Firm* — Andrew C. Cheng; Wei Te Chung; Ming Chieh Chang

(57) ABSTRACT

The present invention provides an electrical socket comprising a wafer defining a plurality of slots extending between an upper face and a lower face of the wafer; an upper frame mounted on the upper face of the wafer, a lower frame mounted on the lower face of the wafer, and a plurality of contacts each having a base portion floating received in corresponding slots. The upper frame defines a plurality of interior walls to form a plurality of first openings. The lower frame defines a plurality of interior walls to form a plurality of second openings. The contact comprises an upper contacting arm extending through a corresponding first opening and beyond an upper surface of the upper frame, and a lower contacting arm extending through a corresponding second opening and beyond a lower surface of the lower frame.

18 Claims, 9 Drawing Sheets

ELECTRICAL SOCKET HAVING CONTACT TERMINALS FLOATABLY ARRANGED THEREIN

BACKGROUND OF THE INVENTION

1. Field of the Invention

The present invention relates to an electrical socket, and more particularly to an electrical socket having contact terminals floatably arranged within the socket thereby reducing deformation and strain resulted from interferential engagement between the contact terminals and the socket.

2. Background of the Invention

Electrical socket is widely used for electrically and mechanically connecting an electronic package such as a CPU to a PCB such as a motherboard. Generally, LGA (land grid array) socket serves as a role for electrically and mechanically connecting an electronic package and a PCB. A typical LGA socket is typically disclosed in U.S. Pat. No. 7,044,746 issued to Copper on May 16, 2006. The LGA socket generally comprises a number of spring contacts, which are configured with conductive pads on the electronic package. As the LGA socket and the electronic mate, the spring contacts exert a normal force on the conductive pads, thus ensuring proper electrical contact between the conductive pads of the electronic package and the spring contacts. Usually, a typical LGA socket further comprises a housing surrounding by a metallic frame, a loading device comprising a load plate and a load lever for pressing and securing a LGA package.

Generally, the spring contact has a retaining portion secured in passageway of the socket and a spring arm extending from the retaining portion and beyond an upper face of the socket, so as to mate with the corresponding conductive pad on the electronic package. Typically, during mating, the spring arms are deflected. Thus, the spring arm needs enough strength and flexibility to meet requirement of deformation. Since the higher the normal force provided by the spring arm, the more reliability can the socket connector provides. Accordingly, the industry tends to make the socket with higher normal force so as to provide a reliable interconnection.

Additionally, socket with higher normal force also brings some side effects. First, when an electrical socket having a plurality of high flexible contacts is mounted onto a PCB by a clamping fixture, the PCB will be more readily prone to warpage because the contacts exert a higher normal force than ordinary contacts. Additionally, a loading device is used in a LGA socket for pressing the electronic package toward the spring contact and securing the LGA package in the LGA socket. Thus, higher normal force will cause a higher interferential engagement force between the contact terminals and the socket when the LGA package is pressed and secured, especially when number of spring contacts exceeds more than 1500.

Therefore, there is a heretofore unaddressed need in the industry to address the aforementioned deficiencies and inadequacies.

SUMMARY OF THE INVENTION

Accordingly, an object of the present invention is to provide an electrical socket having contact terminals floatably arranged within the socket thereby reducing deformation and strain resulted from interferential engagement between the contact terminals and the socket.

To achieve the above-mentioned object, in a preferred embodiment of the present invention, the present invention provides an electrical socket comprising a wafer defining a plurality of slots extending between an upper face and a lower face of the wafer, an upper frame mounted on the upper face of the wafer, a lower frame mounted on the lower face of the wafer, and a plurality of contacts each having a base portion floatably or moveably received in corresponding slot. The upper frame defines a plurality of interior walls to form a plurality of first openings. The lower frame defines a plurality of interior walls to form a plurality of second openings. The contact comprises an upper contacting arm extending through a corresponding first opening and beyond an upper surface of the upper frame, and a lower contacting arm extending through a corresponding second opening and beyond a lower surface of the lower frame. The contacts of the present invention are floatably or moveably disposed in the electrical socket such that interferential engagement force is reduced when the electrical package is pushed toward the electrical socket. Moreover, warpage of the Printed Circuit Board (PCB) is reduced when the socket is mounted onto the PCB under condition that the socket with higher normal force so as to provide a reliable interconnection.

Other objects, advantages and novel features of the present invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
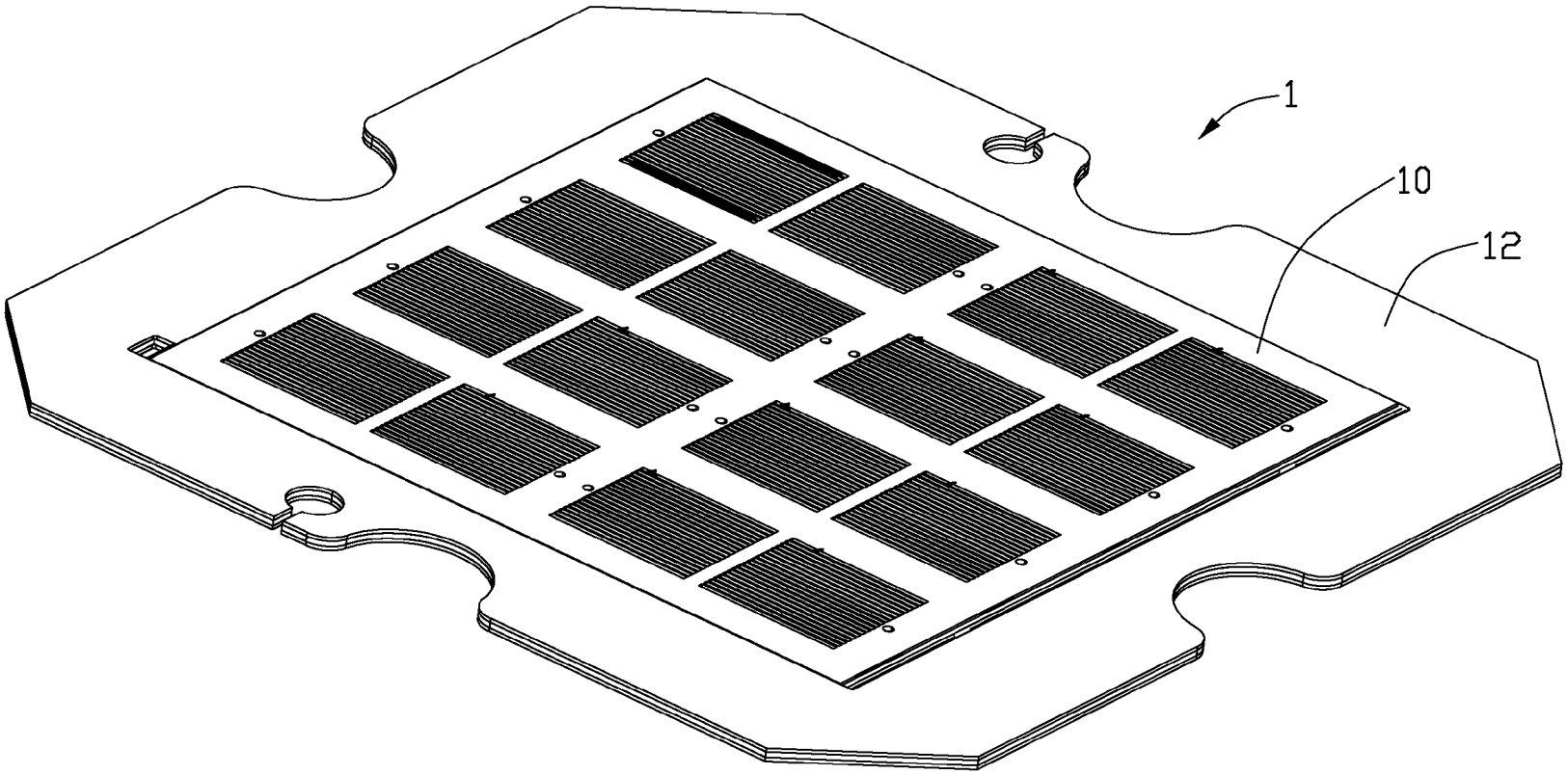
FIG. 1 is a perspective view of an assembled socket in accordance with the present invention.
Figure 2:
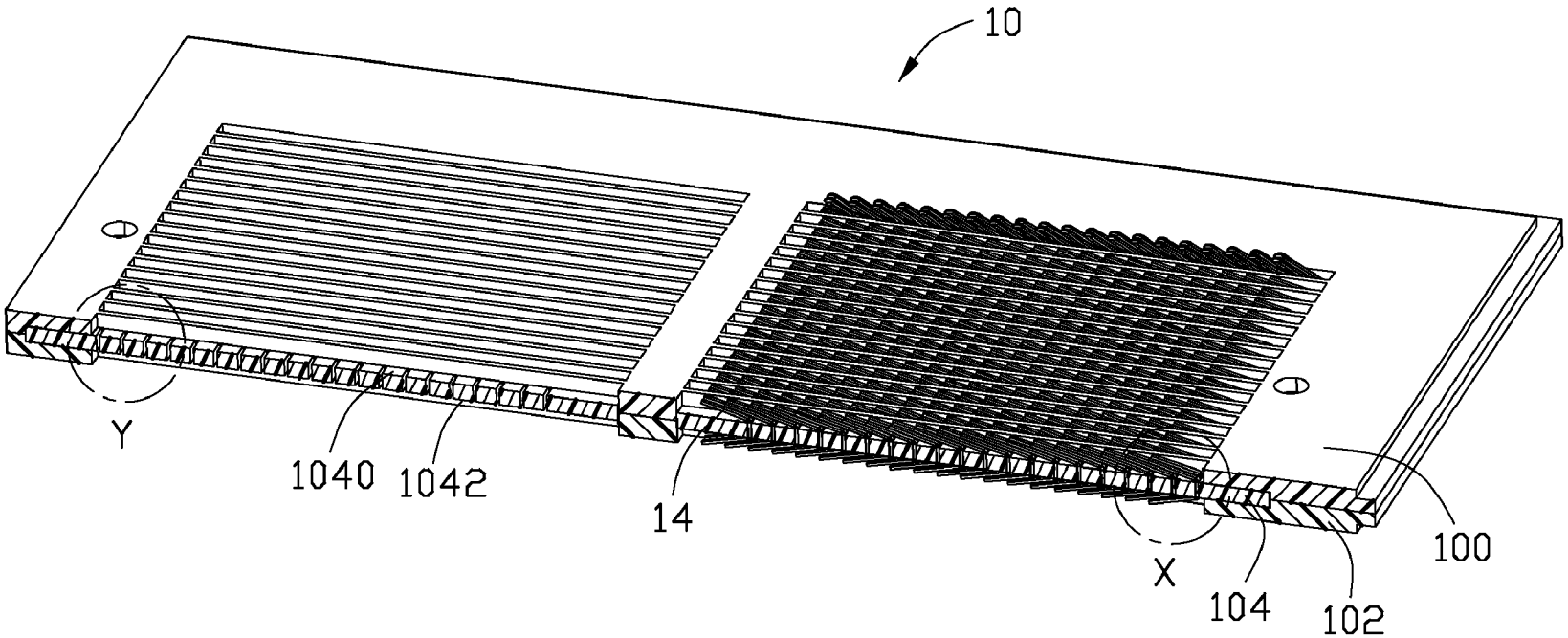
FIG. 2 is cross-sectional view of portion of a socket body of the electrical socket in accordance with a preferred embodiment shown in FIG. 1.
Figure 3:
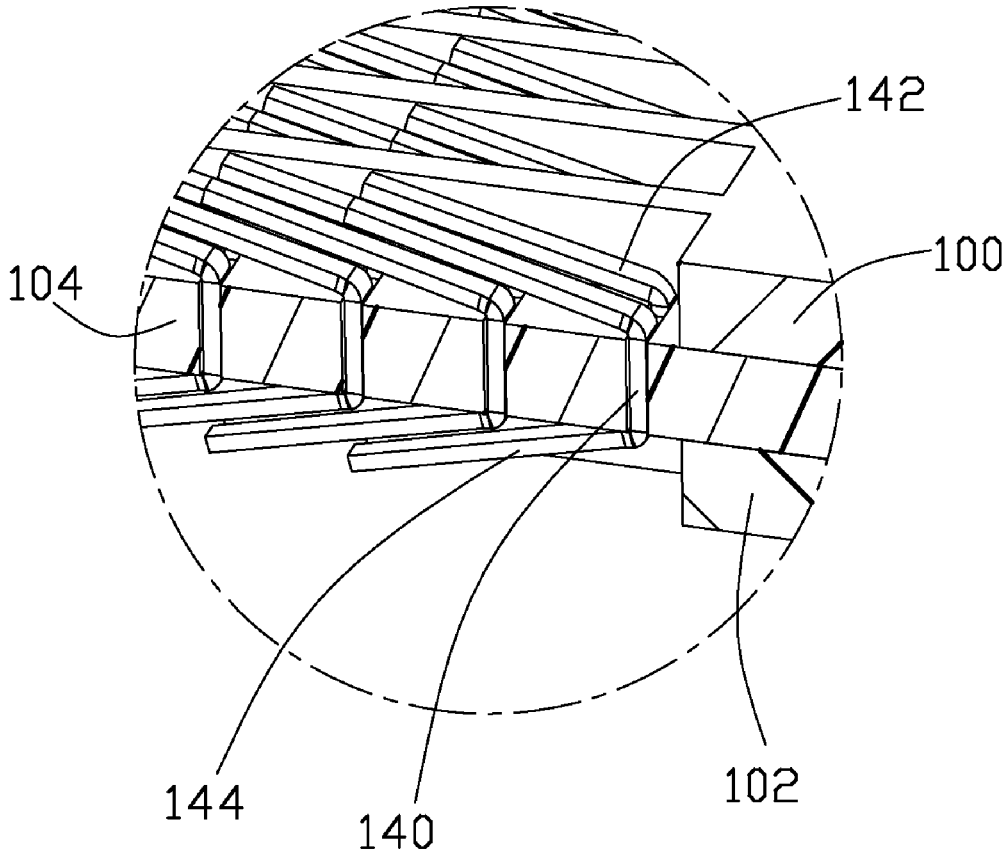
FIG. 3 is an enlarged view of the circle portion X of the FIG. 2.
Figure 4:
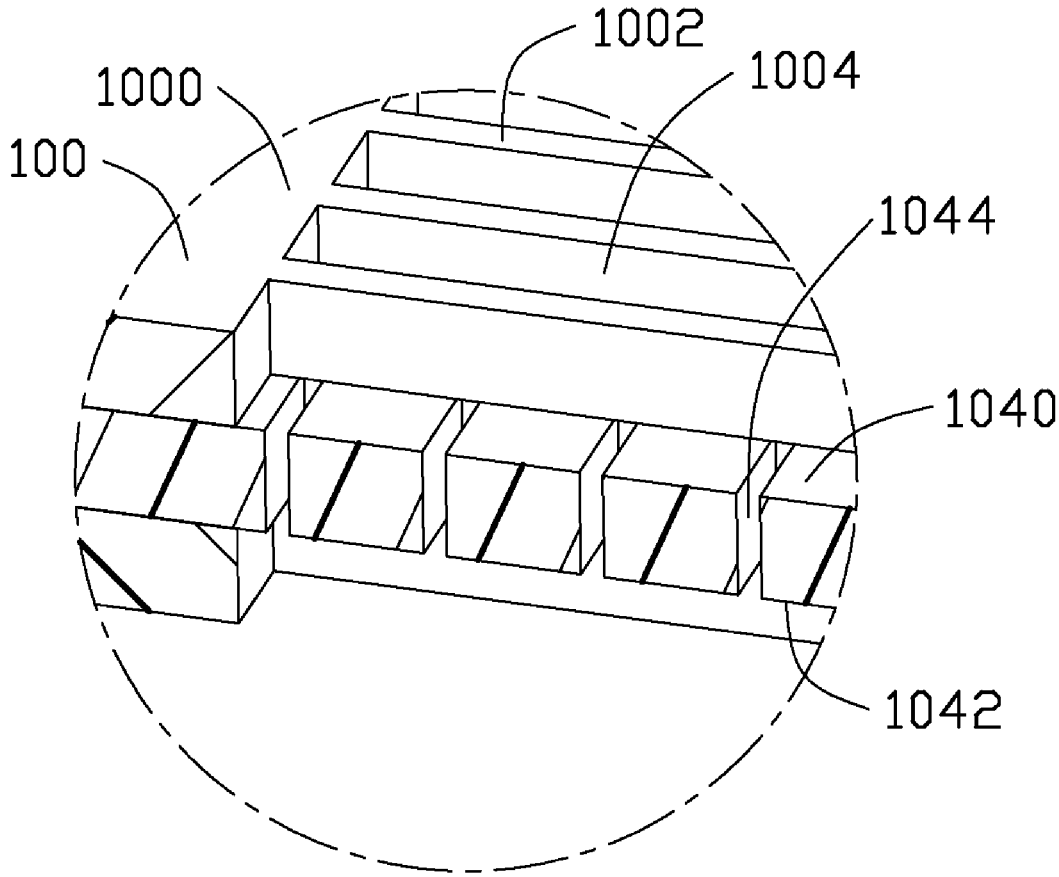
FIG. 4 is an enlarged view of the circle portion Y of the FIG. 2.
Figure 5:
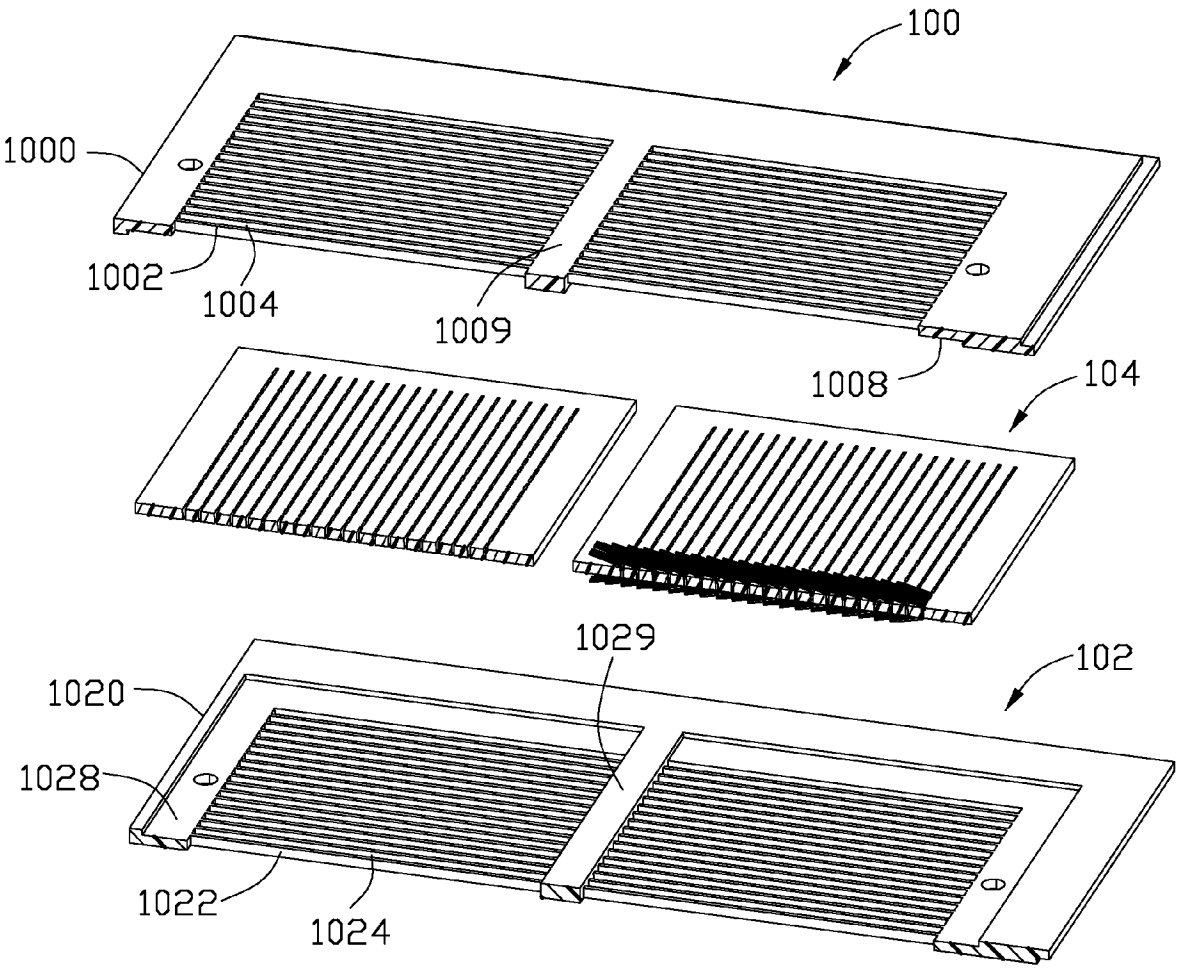
FIG. 5 is an exploded view of the socket body of electrical socket in accordance with a preferred embodiment.
Figure 6:
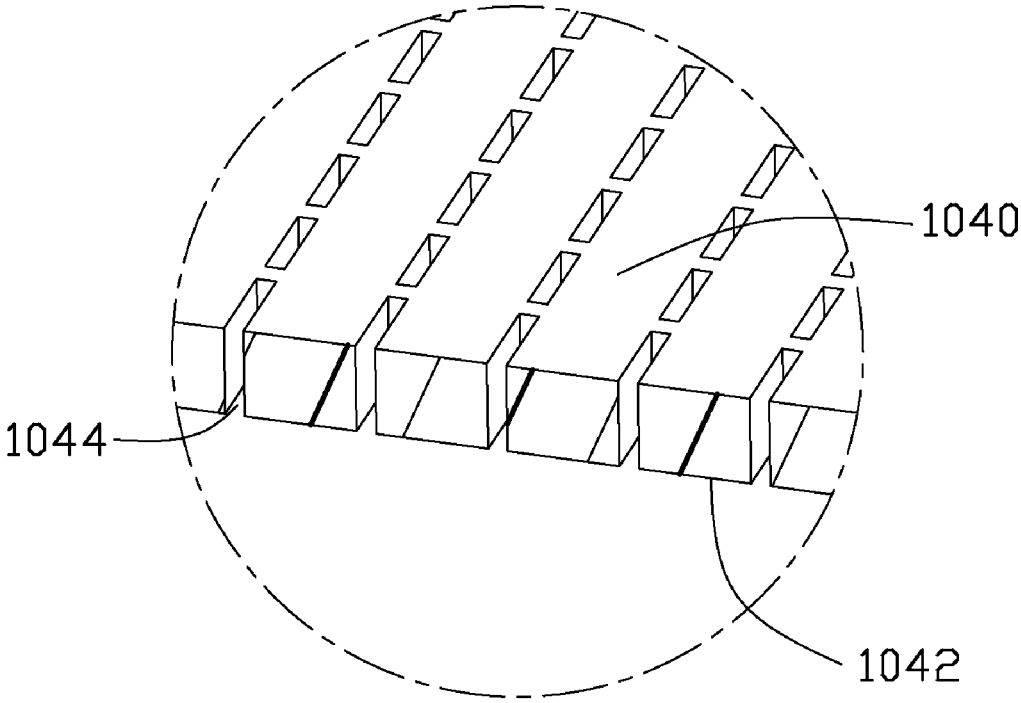
FIG. 6 is an enlarged view of the circle portion Z of the FIG. 5.

Referring to FIG. 1, the electrical socket 1 in accordance with a preferred embodiment comprises a socket body 10 and a bracket 12 surrounding or supporting the socket body 1. The socket body 10 comprises a plurality of section each having a plurality of contacts 14 received therein. Obviously, number of the sections can be predetermined according to layout of design. Thus, referring to FIG. 2, in order to get a detailed description, a simplified/illustrated structure of the socket body 10 just comprising two sections is shown.

Referring to FIGS. 2-6, the socket body 10 comprises an upper frame 100, a lower frame 102, and a wafer 104 disposed and supported between the two frames 100, 102. The wafer 104 defines an upper face 1040, a lower face 1042 opposite to the upper face 1040, and a plurality of slots 1044 arranged in an array configured with rows and columns and extending between the upper face 1040 and the lower face 1042. A plurality of contacts 14 each has a base portion 140 floatably received in corresponding slots 1044, an upper contacting arm 142 extending from an upper portion of the base portion 140 and located above the upper face 1040 for preventing the contact 14 from falling out from the lower face 1042, and a lower contacting arm 144 extending from a lower portion of the base portion 140 and located below the lower face 1042 for preventing the contact 14 from falling out from the upper face 1040. The wafer 104 comprises two parts each having a plurality of contacts 14 therein. The upper contacting arm 142 comprises two arms spaced and opposite to each other. The lower contacting arm 144 comprises two arms spaced and opposite to each other.

The upper frame 100 is mounted onto the upper face 1040 of the wafer 104. The upper frame 100 defines two opposite first exterior walls 1000 with a first group of interior walls 1002 extending therebetween to form a plurality of first openings 1004 such that the upper contacting arm 142 extends in the opening 1004 and beyond an upper interface 1006 of the interior wall 1002.

The lower frame 102 is mounted on the wafer from the lower face 1042 of the wafer 104. The lower frame 102 defines two opposite second exterior walls 1020. A second group of the interior walls 1022 extend between the second exterior walls 1020 along a row direction to form a plurality of second openings 1024 such that the lower contacting arm 144 extends in the second opening 1024 and beyond a lower interface 1026 of the second group of interior wall 1022 of the lower frame 102.

Reference is also made to FIGS. 2-6, pair of first recess 1008 is disposed on a bottom face of the first exteriors 1000 respectively. Similarly, a pair of second recess 1028 is disposed on an upper face of the second exteriors 1020 respectively. Accordingly, when the frames are mounted to the wafer 104, edges of the wafer 104 are disposed in the first recess 1008 and second recess 1028. In this embodiment, depth of the first recess 1008, second recess 1028 added together is equal to thickness of the edge of the wafer 104. Additionally, the upper frame 100 defines a first middle portion 1009, and the lower frame 100 correspondingly defines a second middle portion 1029. Therefore, when the two frames 100, 102 and the wafer 104 are assembled, an interface region is formed in a middle portion of the socket body 10. In other words, the interface region divides the socket body 10 into two sections. Obviously, number of sections of the socket body 10 is corresponding to number of the parts of the wafer 104. Accordingly, the upper frame 100 and the lower frame 102 will be modified to meet new trend/requirement, e.g. size of the frame will be increased and amount of the middle portions will be increased. When amount of the parts of the wafer 104 arranged in a same row exceed two, some recesses will be disposed on the middle portions such that some parts of the wafer 104 are secured between two middle portions.

Figure 7:
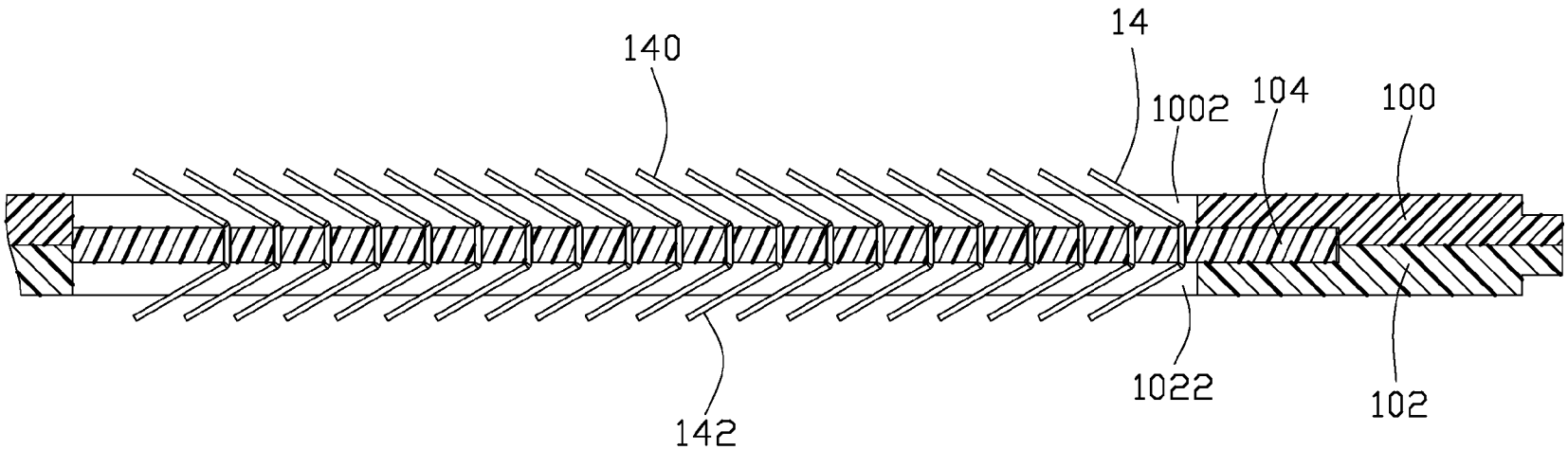
FIG. 7 is a cross-sectional view of the socket body of the electrical socket of FIG. 2.

Reference is made to FIG. 7, a cross-sectional view of the electrical socket 1 is shown, the upper contacting arm 142 of the contact 14 extends away from corresponding slot 1044, in which the corresponding contact 14 received, in the row direction, and invades a space above an adjacent upper contacting arm of an adjacent contact. Similarly, the lower contacting arm 144 extends away from corresponding slot 1044, in which the corresponding contact is received, also in the row direction, and invades a space below an adjacent lower contacting arm of the adjacent contact.

Figure 8:
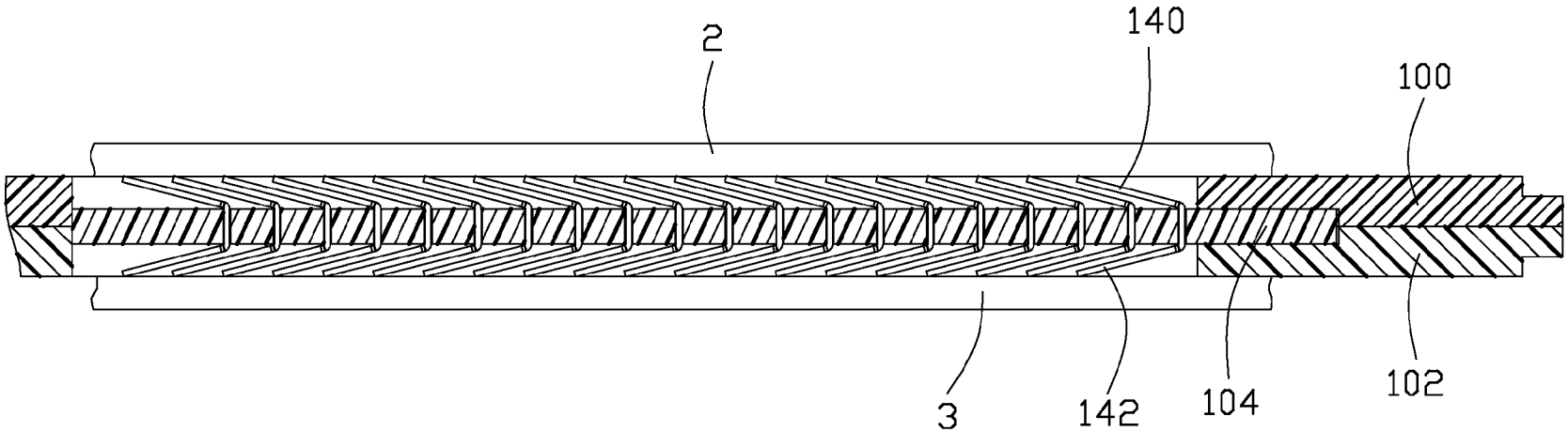
FIG. 8 is a perspective view of the socket body interconnecting with the package and the PCB.
Figure 9:
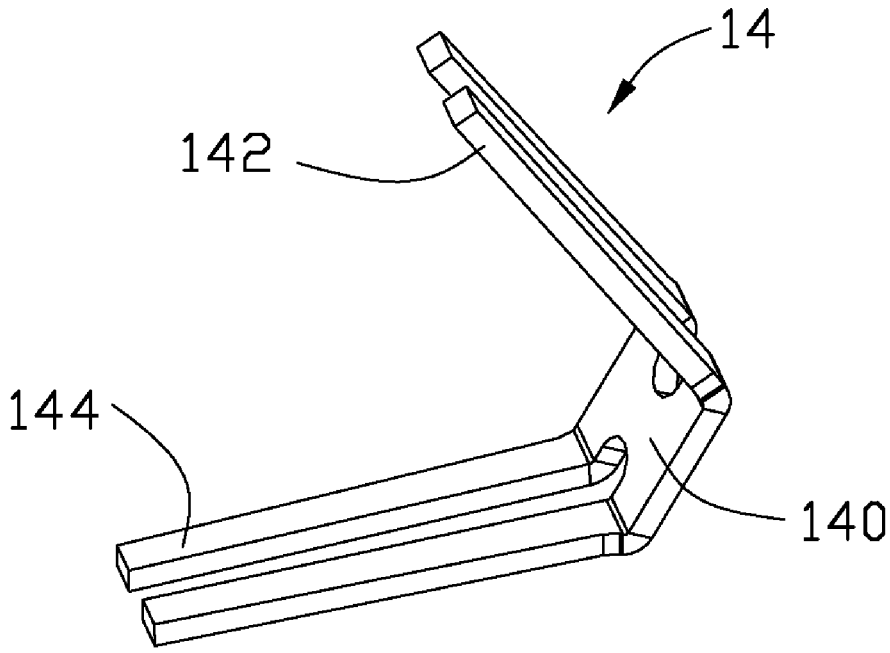
FIG. 9 is a perspective view of the electrical contact in accordance with a preferred embodiment.

Reference is now made to FIG. 8, the electrical socket 1 is mounted on a PCB 3, and an electrical package 2 is mounted onto the electrical socket 1 and pushed toward the electrical socket 1. Therefore, electrical connection between the PCB 3 and the electrical package 2 is provided. The contacts 14 of the present invention are floatably disposed in the socket body 1 such that interferential engagement force is reduced when the electrical package 2 is pushed toward the electrical socket 1. Moreover, warpage of the PCB is reduced when the socket is mounted onto the PCB.

Although the present invention has been described with reference to the accompanying drawings, it is not to be construed as being limited thereto. Various alterations and modifications can be made to the embodiments without in any way departing from the scope or spirit of the present invention as defined in the appended claims. Such modifications and alterations that may be apparent to a person skilled in the art are intended to be included within the scope of this invention as defined in by the accompanying claims.

What is claimed is:

1. An electrical socket comprising:

a wafer defining an upper face and a lower face opposite to the upper face, a plurality of slots arranged in rows and columns and extending through the upper face and the lower face;

a plurality of contacts each having a base portion floatably received in the slots, an upper contacting arm extending from an upper portion of the base portion and located above the upper face for preventing the contact from falling out from the lower face, and a lower contacting arm extending from a lower portion of the base portion and located below the lower face for preventing the contact from falling out from the upper face;

an upper frame mounted on the wafer from the upper face, defining a first group of interior walls to form a plurality of first openings such that each upper contacting arm extends through the opening and beyond an upper interface of the interior wall; and a lower frame mounted on the wafer from the lower face, defining a second group of interior walls to form a plurality of second openings such that each lower contacting arm extends in the opening and beyond a lower interface of the interior wall of the lower frame; and wherein during a floatable process of the contact, the upper, lower arms abut against the upper face, the lower faces respectively, thus restricting downward, upwardly movement of the contact respectively.

2. The electrical socket as claimed in claim 1, wherein the upper frame defines first exterior walls with the first group of interior walls extending therebetween, a bottom face of the upper frame defining a first recess for receiving an edge portion of the wafer.

3. The electrical socket as claimed in claim 2, wherein the lower frame defines second exterior walls with the second group of interior walls extending therebetween, an upper face of the lower frame defining a second recess for receiving an edge portion of the wafer, and a depth of the first and second recesses added together is equal to a thickness of an edge of the wafer.

4. The electrical socket as claimed in claim 1, wherein the upper contacting arm extends beyond the corresponding slot, in which the corresponding contact is received, in the row direction, and extends above an adjacent upper contacting arm of an adjacent contact.

5. The electrical socket as claimed in claim 4, wherein the lower contacting arm extends away from corresponding slot, in which the corresponding contact is received, in the row direction, and extends below an adjacent lower contacting arm of the adjacent contact.

6. The electrical socket as claimed in claim 5, wherein the upper contacting arm comprises two arms spaced and opposite to each other.

7. The electrical socket as claimed in claim 6, wherein the lower contacting arm comprises two arms spaced and opposite to each other.

8. The electrical socket as claimed in claim 7, wherein further comprises a bracket for holding the upper frame, the lower frame and the wafer together.

9. An electrical socket comprising:

a wafer defining a plurality of slots extending between an upper face and a lower face of the wafer;

an upper frame mounted on the upper face of the wafer, defining a first group of interior walls to form a plurality first openings;

a lower frame mounted on the lower face of the wafer, defining a second group of interior walls to form a plurality second openings;

a plurality of contacts each having a base portion floatably received in corresponding slots, an upper contacting arm extending through a corresponding first opening and beyond an upper surface of the upper frame, and a lower contacting arm extending through a corresponding second opening and beyond a lower surface of the lower frame; and wherein the upper contacting arm extends beyond the corresponding slot, in which the corresponding contact is received, in the row direction, and extends above an adjacent upper contacting arm of an adjacent contact.

10. The electrical socket as claimed in claim 9, wherein the upper frame defines first exterior walls with the first group of interior walls extending therebetween, a bottom face of the upper frame defining a first recess for receiving an edge portion of the wafer.

11. The electrical socket as claimed in claim 10, wherein the lower frame defines second exterior walls with the second group of interior walls extending therebetween, an upper face of the lower frame defining a second recess for receiving an edge portion of the wafer, and a depth of the first and second recesses added together is equal to a thickness of an edge of the wafer.

12. A method of assembling a socket with floating terminals therein, comprising steps of:

providing a wafer with a plurality of terminals in a matrix under condition that each of said terminals defines opposite deflectable upper and lower contact arms extending obliquely beyond opposite upper and lower surfaces of the wafer;

providing opposite upper and lower frames upon the upper surface and the lower surface to cooperatively sandwich the wafer therebetween in a vertical direction; wherein each of said upper frame and said lower frame defining a plurality of through slots to allow the corresponding upper contact arms and lower contact arms to extend therethrough and beyond the upper frame and the lower frame for respectively contacting an electronic package and a printed circuit board; and wherein said terminals are floating inside the wafer.

13. The electrical socket as claimed in claim 9, wherein the lower contacting arm extends away from corresponding slot, in which the corresponding contact is received, in the row direction, and extends below an adjacent lower contacting arm of the adjacent contact.

14. The electrical socket as claimed in claim 13, wherein the upper contacting arm comprises two arms spaced and opposite to each other.

15. The electrical socket as claimed in claim 14, wherein the lower contacting arm comprises two arms spaced and opposite to each other.

16. The electrical socket as claimed in claim 15, wherein further comprises a bracket for holding the upper frame, the lower frame and the wafer together.

17. The method as claimed in claim 12, wherein each of said upper contact arms and said lower contact arms in a same row extends in a row direction along which the corresponding slot extends, under condition that a tip of each of the upper contact arms and the lower contact arms extends beyond a first contact neighbor and reaches a second neighbor contact in a top view when the terminals are compressed by the electronic package and the printed circuit board.

18. The method as claimed in claim 12 wherein each of said terminals includes a planar main body floatably received in a corresponding passageway in the wafer while both the corresponding upper contact arm and lower contact arm are fully exposed outside the wafer.

* * * * *